US009101256B2

(12) United States Patent
Guo et al.

(10) Patent No.: US 9,101,256 B2
(45) Date of Patent: Aug. 11, 2015

(54) CENTRIFUGAL PUMP

(75) Inventors: Chuan Jiang Guo, Shenzhen (CN); Chuan Hui Fang, Hong Kong (CN)

(73) Assignee: Johnson Electric S.A., Murten (CH)

( * ) Notice: Subject to any disclaimer, the term of this patent is extended or adjusted under 35 U.S.C. 154(b) by 877 days.

(21) Appl. No.: 13/352,571

(22) Filed: Jan. 18, 2012

(65) Prior Publication Data

US 2012/0180826 A1 Jul. 19, 2012

(30) Foreign Application Priority Data

Jan. 18, 2011 (CN) ..... 2011 1 0023362

(51) Int. Cl.

| | |
|---|---|
| ***F04D 29/42*** | (2006.01) |
| ***A47L 15/42*** | (2006.01) |
| ***F04D 29/44*** | (2006.01) |
| ***D06F 39/08*** | (2006.01) |

(52) U.S. Cl.

CPC ..... *A47L 15/4225* (2013.01); *D06F 39/085* (2013.01); *F04D 29/428* (2013.01); *F04D 29/445* (2013.01)

(58) Field of Classification Search

None

See application file for complete search history.

(56) References Cited

U.S. PATENT DOCUMENTS 5,947,892 A * 9/1999 Benkowski et al. ..... 600/16
6,312,237 B2 * 11/2001 Kouno et al. ..... 418/61.1

* cited by examiner

*Primary Examiner* — Jason Ko

(74) *Attorney, Agent, or Firm* — Muncy, Geissler, Olds & Lowe, P.C.

(57) ABSTRACT

A centrifugal pump has an electric motor, an impeller driven by the motor and a spiral volute. The impeller has an annular base plate and a plurality of vanes arranged on the base plate. The spiral volute has an inlet, an outlet and an impeller chamber in which the impeller is disposed. The inlet extends outwardly from a top wall of the volute. The outlet extends outwardly from a side wall of the volute in the spiral direction of the volute. The spiral volute has a wrap angle between 360 to 460 degrees. A washing apparatus incorporating the centrifugal pump is also provided.

11 Claims, 4 Drawing Sheets

CENTRIFUGAL PUMP

CROSS REFERENCE TO RELATED APPLICATIONS

This non-provisional patent application claims priority under 35 U.S.C. §119(a) from Patent Application No. 201110023362.9 filed in The People's Republic of China on Jan. 18, 2011.

FIELD OF THE INVENTION

This invention relates to a centrifugal pump especially for a dishwasher and in particular, to a centrifugal pump having a spiral volute.

BACKGROUND OF THE INVENTION

In dishwashers, a circulating pump is used for re-circulating water with detergent to a washing chamber via a circulating path. The circulating pump is usually a centrifugal pump having a motor, an impeller driven by the motor, and a spiral volute with an inlet, an outlet and an impeller chamber for receiving the impeller.

In a traditional centrifugal pump, the wrap angle of the spiral volute is less than 360 degrees and the volute is fixed to the motor by connecting a plurality of mounting portions extending radially from the outer surface of the volute to a bracket of the motor.

For different dishwasher manufacturers, the requirements for the mounting distance between the center line of the outlet of the pump volute and the rotating center of the motor shaft are different, which results in the radial dimensions of the volutes of the pumps also being different. As shown in FIG. 8, the mounting distance M1 of the volute drawn in dashed lines is greater than the mounting distance M2 of the volute drawn in solid lines. Since the wrap angle of the volute is less than 360 degrees, the radial dimension D1 of the volute in dashed lines is also greater than the radial dimension D2 of the volute in solid lines. Thus, a motor supplier has to produce motors having brackets with different radial dimensions to match different volutes of the pumps for different dishwasher manufacturers.

SUMMARY OF THE INVENTION

According to a first aspect thereof, the present invention provides a centrifugal pump comprising: an electric motor with a shaft; an impeller driven by the shaft, the impeller having an annular base plate and a plurality of vanes arranged on the base plate; and a spiral volute with an inlet, an outlet and an impeller chamber for receiving the impeller, the inlet extending outwardly from a top wall of the volute, the outlet extending outwardly from a side wall of the volute in a spiral direction of the volute, wherein the spiral volute has a wrap angle $\delta$ of between 360 to 460 degrees.

Preferably, the wrap angle $\delta$ is between 380 to 440 degrees.

Preferably, the volute has a lip angle $\beta$ between 2 to 6 degrees.

Preferably, the volute has a tongue angle $\alpha$ between 33 to 45 degrees.

Preferably, each vane has a radially inner edge, a radially outer edge and a leading edge connecting the radially inner edge and the radially outer edge, the radially inner edge and the leading edge forming a corner.

Preferably, the radially inner edge of the vane forms an angle $\gamma$ of between 22 to 30 degrees with the shaft.

Preferably, the radially outer edge of the vane is aligned with the radially outer surface of the base plate.

Alternatively, a radially outer surface of the base plate extends beyond the radially outer edges of the vanes.

Preferably, an inner surface of the top wall of the volute conforms to the leading edges of the vanes.

Preferably, the minimum distance between the inner surface of the top wall of the volute and the leading edges is less than 0.02 D, where D is an outer diameter of the base plate.

According to a second aspect, the present invention also provides a washing apparatus comprising: a washing chamber; a water supply path for supplying water to the washing chamber; a drain path for discharging water from the washing chamber; a circulating path for re-circulating the water in the washing chamber; and a control system having a drain pump and a circulating pump, the drain pump removing water from the washing chamber via the drain path and the circulating pump re-circulating the water within the washing chamber via the circulating path, wherein at least one of the circulating pump and the drain pump is a centrifugal pump as defined above.

When different manufacturers have different requirements for the mounting distance between the center line of the outlet of the pump volute and the rotating center of the motor shaft, by increasing the wrap angle of the spiral volute with relatively large mounting dimension, the radial dimension of this volute can be reduced without the mounting distance being changed, accordingly the motor bracket matching the volute can also be reduced. Thus the motor supplier may produce motors having brackets with the same radial dimensions to match different volutes of the pumps for different manufacturers.

BRIEF DESCRIPTION OF THE DRAWINGS

A preferred embodiment of the invention will now be described, by way of example only, with reference to figures of the accompanying drawings. In the figures, identical structures, elements or parts that appear in more than one figure are generally labeled with a same reference numeral in all the figures in which they appear.

Dimensions of components and features shown in the figures are generally chosen for convenience and clarity of presentation and are not necessarily shown to scale. The figures are listed below.

DETAILED DESCRIPTION OF THE PREFERRED EMBODIMENTS

Figure 1:
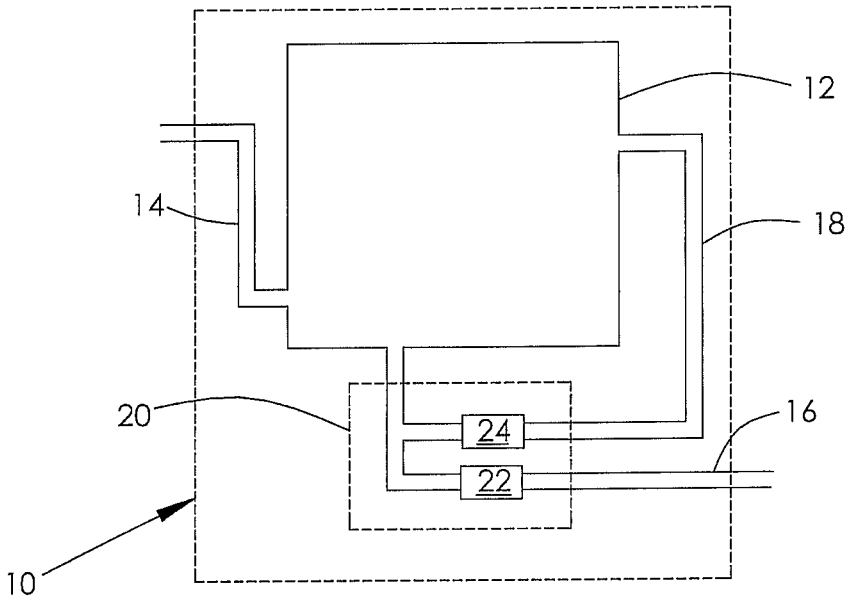
FIG. 1 is a schematic view of a washing apparatus incorporating a centrifugal pump according to the present invention.
Figure 2:
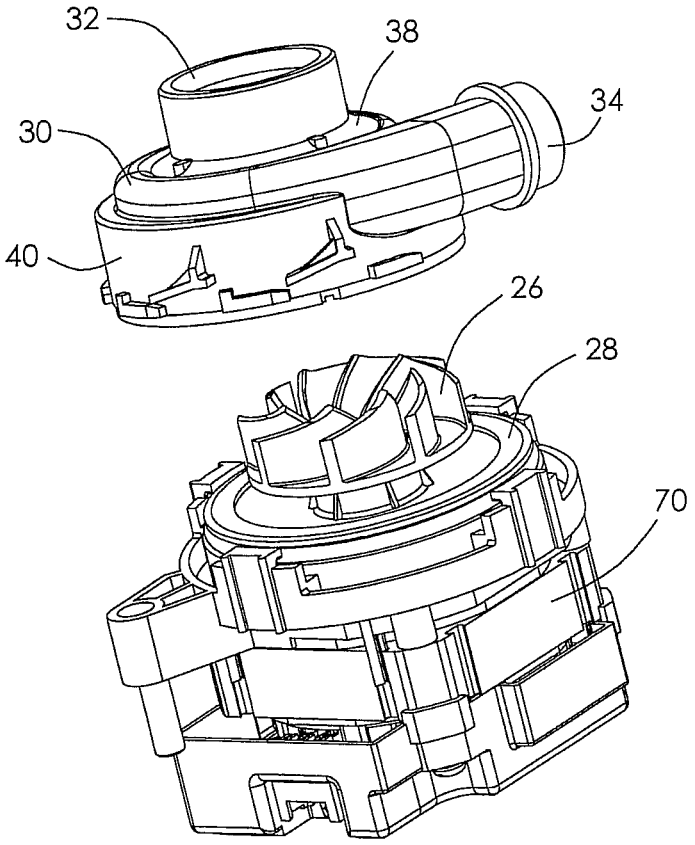
FIG. 2 is a partially exploded view of the centrifugal pump of FIG. 1.
Figure 3:
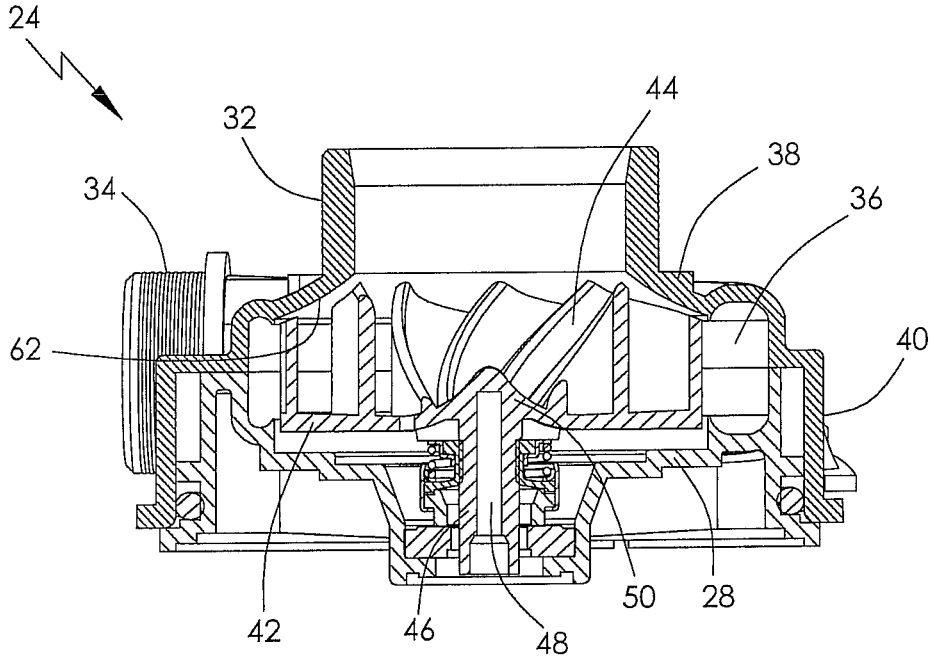
FIG. 3 is a sectional view of the pump section of the centrifugal pump of FIG. 2.
Figure 4:
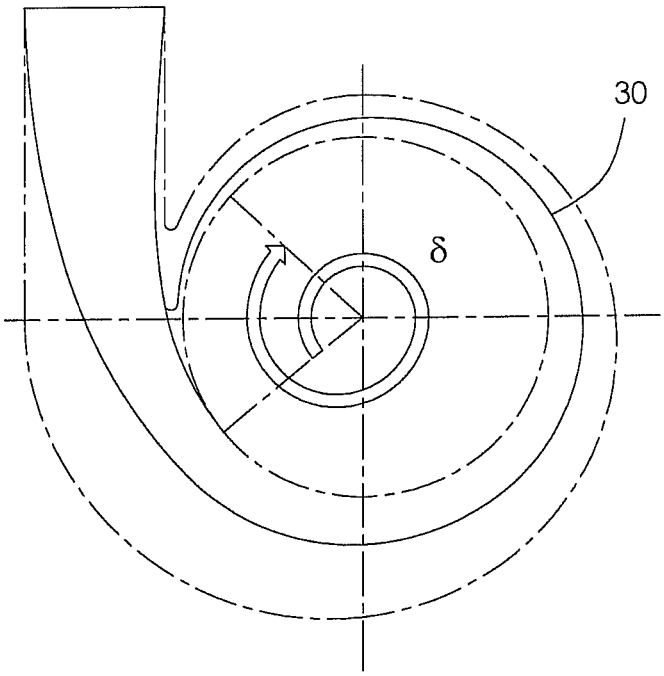
FIGS. 4 and 5 show plan profiles of the centrifugal pump.
Figure 5:
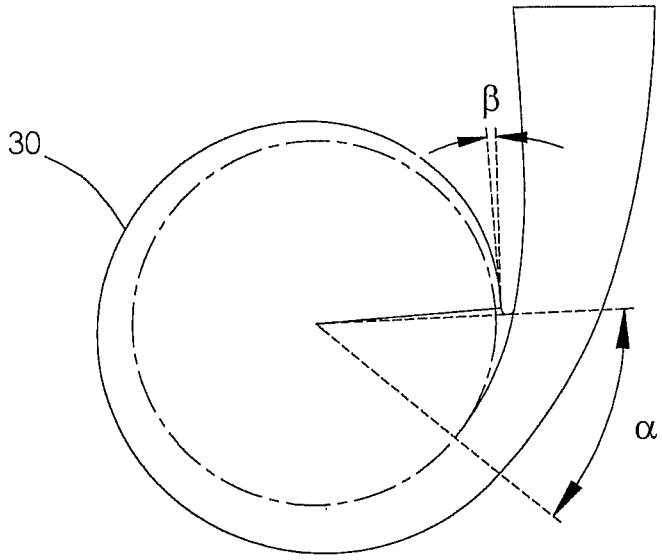

Referring to FIG. 1, a washing apparatus 10, such as a dishwasher or a washing machine, has a washing chamber 12, a water supply path 14 for supplying fresh water to the washing chamber 12, a drain path 16 for discharging waste water to the outside, a circulating path 18 for re-circulating the water with detergent to the washing chamber 12, and a control system 20 having a drain pump 22 and a circulating pump 24. The drain pump 22 removes the liquid in the washing chamber 12 via the drain path 16 and the circulating pump 24 circulates the liquid within the washing chamber via the circulating path 18.

Referring to FIGS. 2 to 5, the circulating pump 24 includes an electric motor 70 with an output shaft (not shown), an impeller 26 fixedly mounted to the output shaft, a base 28, and a spiral volute 30 with an inlet 32 and an outlet 34. The volute 30 is assembled to the base 28 in a sealing way. The base 28 and the volute 30 define an impeller chamber 36 for receiving the impeller 26. The inlet 32 and the outlet 34 are in communication with the impeller chamber 36. The inlet 32 extends outwardly from a top wall 38 of the volute 30 in the axial direction of the shaft. The outlet 34 extends outwardly from a side wall 40 of the volute 30 in a spiral manner. The wrap angle δ of the volute 30 is between 360 to 460 degrees, preferably between 380 to 440 degrees. Compared with the traditional pump, the wrap angle of the volute is increased in this embodiment. By this configuration, the length of the diffuser of the volute is increased and the angle of the diffuser is decreased, which decreases the flow separation of the water flow, thereby improving the efficiency of the pump.

Preferably, the lip angle β of the volute 30 is between 2 to 6 degrees and the tongue angle α of the volute 30 is between 33 to 45 degrees. The lip angle β of the volute is the angle between lines tangential to the circle of the impeller chamber (usually the same as the outer circumference of the impeller) and tangential to the inner spiral of the volute at points on the same radial line. The tongue angle α is the angle between the radial line passing through the start point of the spiral volute (the point where the spiral volute is projected to contact the circle of the impeller chamber and the radial line touching the tip of the tongue. The lip angle and the tongue angle affect operating characteristics of the pump. By this configuration, a circulating pump for a dishwasher, with a rotational speed of about 3000 rpm, a water flow rate of 30 lpm to 60 lpm and an impeller outer diameter of 45 mm to 55 mm, can achieve a relatively high efficiency and a relatively low noise.

Figure 6:
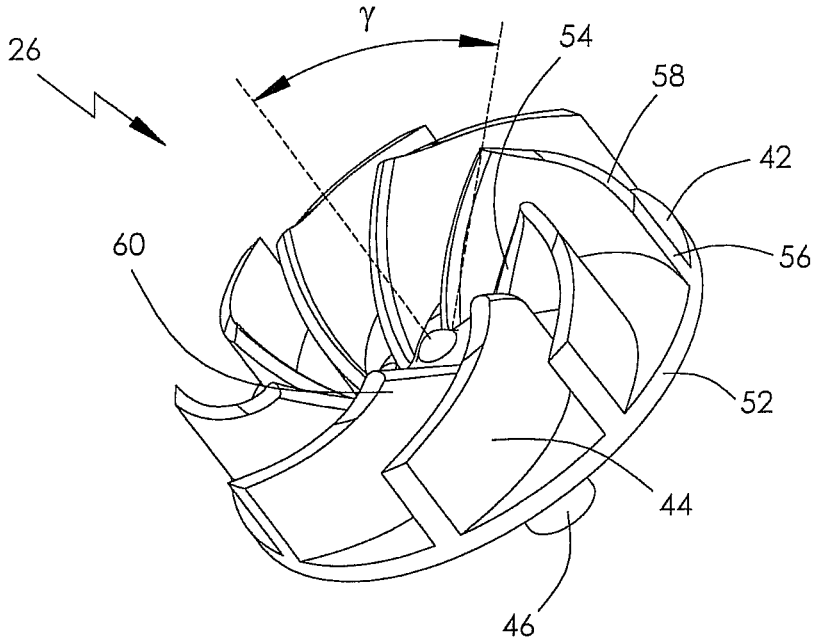
FIG. 6 is a view of an impeller, being a part of the centrifugal pump.

Also referring to FIG. 6, the impeller 26 includes an annular base plate 42 and a plurality of vanes 44 uniformly disposed on the base plate 42 in the circumferential direction of the shaft. The base plate 42 has a hub which comprises a mounting post 46 with a mounting hole 48 and a cone 50 extending from the mounting post 46. The shaft of the motor is inserted into the mounting hole 48 to fix the impeller 26 to the shaft. The vanes 44 extend from the cone 50, along a curved path, to the radially outer surface 52 of the base plate 42 and are aligned flush with the radially outer surface 52 in the axial direction. Each vane 44 has a radially inner edge 54 inclined to the shaft, a radially outer edge 56, and a leading edge 58 connecting the radially inner edge 54 and the radially outer edge 56. The radially inner edge 54 and the leading edge 58 form a corner 60.

Preferably, the radially inner edge 54 of the vane 44 forms an angle γ between 22 to 30 degrees with the shaft. By this configuration, liquid, such as the water detergent mix of the dishwasher, can smoothly flow into the channels between the vanes 44. Furthermore, the inner surface 62 of the top wall 38 of the volute 30 conforms to the leading edges 58 of the impeller 26 and the minimum distance between them is less than 0.02 D, where D is an outer diameter of the base plate 42.

Figure 7:
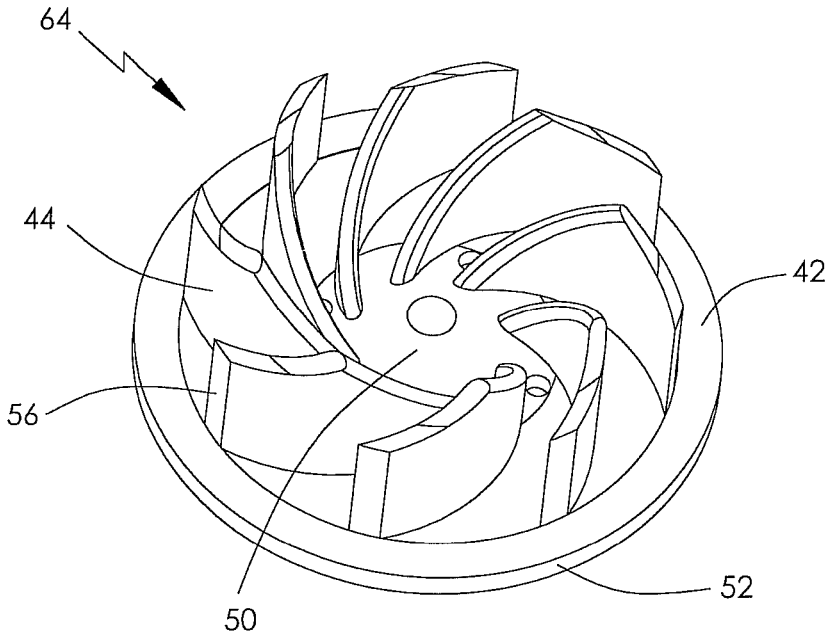
FIG. 7 is a view of another impeller according to a second embodiment of the present invention.
Figure 8:
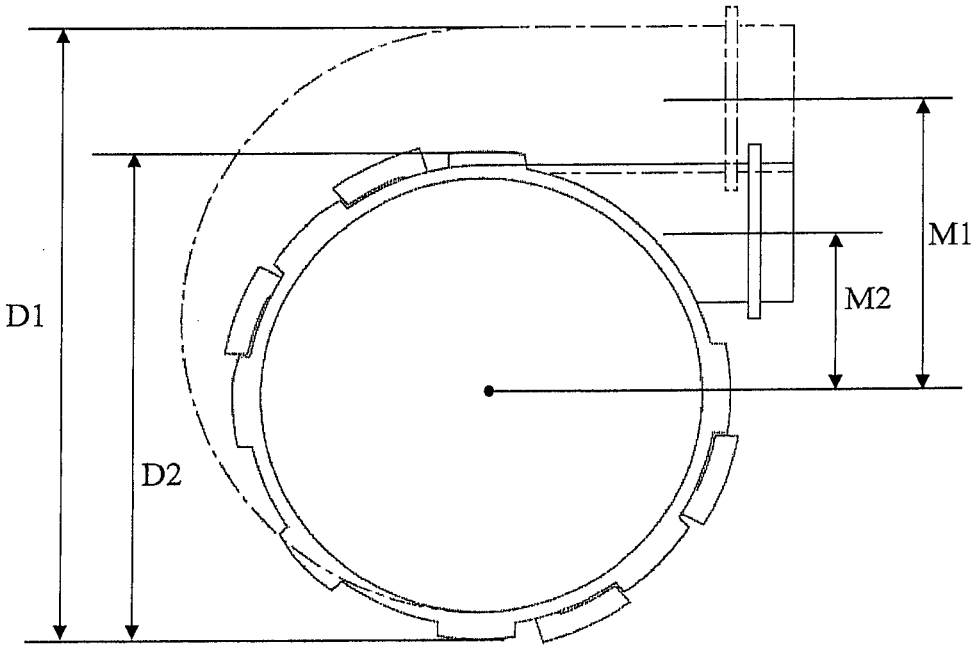
FIG. 8 (Prior Art)
FIG. 8 illustrates a dimension relationship between two traditional pumps.

FIG. 7 shows another impeller 64 for the circulating pump. In this impeller, the radially outer surface 52 of the base plate 42 extends beyond the radially outer edges 56 of the vanes 44 in the radial direction. Compared to impeller 26, impeller 64 provides a pump with a smaller output power as the vanes have a shorter radial length. Thus, by keeping the diameter of the base plate of the impeller the same, the output power of the pump can be reduced by reducing the radial length of the vanes to match the output of the pump to the required output for a particular application, simply by changing the impeller.

In the description and claims of the present application, each of the verbs "comprise", "include", "contain" and "have", and variations thereof, are used in an inclusive sense, to specify the presence of the stated item but not to exclude the presence of additional items.

Although the invention is described with reference to one or more preferred embodiments, it should be appreciated by those skilled in the art that various modifications are possible. Therefore, the scope of the invention is to be determined by reference to the claims that follow.

For example, while the pump is described as a circulating pump, it can also be used as a drain pump.

The invention claimed is:

1. A centrifugal pump comprising:

an electric motor with a shaft;

an impeller driven by the shaft, the impeller having an annular base plate and a plurality of vanes arranged on the base plate; and a spiral volute with an inlet, an outlet and an impeller chamber for receiving the impeller, the inlet extending outwardly from a top wall of the volute, the outlet extending outwardly from a side wall of the volute in a spiral direction of the volute, wherein the spiral volute has a wrap angle δ between 360 to 460 degrees.

2. The centrifugal pump of claim 1, wherein the wrap angle δ is between 380 to 440 degrees.

3. The centrifugal pump of claim 1, wherein the volute has a lip angle β between 2 to 6 degrees.

4. The centrifugal pump of claim 1, wherein the volute has a tongue angle α between 33 to 45 degrees.

5. The centrifugal pump of claim 1, wherein each vane has a radially inner edge, a radially outer edge and a leading edge connecting the radially inner edge and the radially outer edge, the radially inner edge and the leading edge forming a corner.

6. The centrifugal pump of claim 5, wherein the radially inner edge of the vane forms an angle γ of between 22 to 30 degrees with the shaft.

7. The centrifugal pump of claim 5, wherein the radially outer edge of the vane is aligned with the radially outer surface of the base plate.

8. The centrifugal pump of claim 5, wherein a radially outer surface of the base plate extends beyond the radially outer edges of the vanes in the radial direction.

9. The centrifugal pump of claim 5, wherein an inner surface of the top wall of the volute conforms to the leading edges of the vanes.

10. The centrifugal pump according to claim 9, wherein the minimum distance between the inner surface of the top wall of the volute and the leading edges is less than 0.02 D, where D is an outer diameter of the base plate.

11. A washing apparatus comprising: a washing chamber; a water supply path for supplying water to the washing chamber; a drain path for discharging water from the washing chamber; a circulating path for re-circulating the water in the washing chamber; and a control system having a drain pump and a circulating pump, the drain pump removing water from the washing chamber via the drain path and the circulating pump re-circulating the water within the washing chamber via the circulating path, wherein at least one of the circulating pump and the drain pump is the centrifugal pump of claim 1.

* * * * *